US005613272A

United States Patent [19]

Huffman

[11] Patent Number: 5,613,272

[45] Date of Patent: Mar. 25, 1997

[54] ACCESSORY CREVICE TOOL FOR USE WITH WATER EXTRACTION CLEANING MACHINE

[75] Inventor: Eric C. Huffman, Lowell, Mich.

[73] Assignee: Bissell Inc., Grand Rapids, Mich.

[21] Appl. No.: 574,769

[22] Filed: Dec. 19, 1995

Related U.S. Application Data

[60] Provisional application No. 60/003,416, filed Sep. 8, 1995.

[51] Int. Cl.[6] ..... A47L 9/02

[52] U.S. Cl. ..... 15/321; 15/322; 15/415.1

[58] Field of Search ..... 15/321, 322, 415.1

[56] References Cited

U.S. PATENT DOCUMENTS

| | | | |
|---|---|---|---|
| 3,866,264 | 2/1975 | Engquist | 15/322 X |
| 3,883,301 | 5/1975 | Emrick et al. | 15/322 X |
| 3,964,925 | 6/1976 | Burgoon | 15/321 X |
| 4,083,077 | 4/1978 | Knight et al. . | |
| 4,333,203 | 6/1982 | Yonkers . | |
| 4,334,336 | 6/1982 | Harbeck et al. | 15/322 |
| 4,458,377 | 7/1984 | Frohbieter | 15/321 X |
| 4,597,124 | 7/1986 | Williams, III et al. . | |
| 4,649,594 | 3/1987 | Grave . | |
| 4,821,364 | 4/1989 | McAllister et al. . | |
| 4,910,828 | 5/1990 | Blase et al. . | |
| 4,984,328 | 1/1991 | Berfeld . | |
| 5,001,806 | 3/1991 | Gurstein . | |
| 5,497,530 | 3/1996 | Kamm et al. | 15/322 X |

*Primary Examiner*—Chris K. Moore

*Attorney, Agent, or Firm*—Varnum, Riddering, Schmidt & Howlett LLP

[57] ABSTRACT

An accessory crevice cleaning tool adapted for use with a water extraction cleaning machine has a solution spray nozzle integrated therewith and a tapered, rectangular nozzle opening which does not exceed the diameter of the hose and grip tube. The spray nozzle can be adapted to provide a pinpoint spray pattern immediately adjacent the nozzle opening, a fan-shaped spray pattern which is parallel to and aligned with the longitudinal axis of the nozzle opening or a fan-shaped spray pattern which is transverse to and spaced from the longitudinal axis of the nozzle opening. Preferably, the accessory crevice cleaning tool is removably mounted to the end of the flexible hose.

36 Claims, 3 Drawing Sheets

ACCESSORY CREVICE TOOL FOR USE WITH WATER EXTRACTION CLEANING MACHINE

This application claims the benefit of U.S. provisional application No. 60/003,416 filed on Sep. 8, 1995, now abandoned.

BACKGROUND OF THE INVENTION

1. Field of the Invention

This invention relates to water extraction cleaning machines and more particularly to an accessory crevice cleaning tool having a spray nozzle integrally formed therewith adapted for use with the cleaning machine.

2. Description of the Related Art

Water extraction cleaning machines are used for cleaning a variety of surfaces including carpet, upholstery, and fabrics. The cleaning process comprises the steps of directing a water and cleaning solution spray at the surface to be cleaned. Next, vacuum is applied to remove at least a portion of the solution mixture along with dirt and dust entrained in the solution.

In a typical water extraction cleaning machine, flexible vacuum and cleaning solution hoses extend from a machine housing which supports a vacuum motor, a clean solution reservoir, a solution pump and a dirty solution reservoir. Accessory tools have been developed for attachment to the terminal end of the flexible hose for a variety of cleaning operations. For example, one known accessory tool comprises a fan-shaped nozzle extending at an acute angle from the longitudinal axis of the grip tube and having a nozzle opening which is oriented transverse to the longitudinal axis of the hose. The longitudinal axis of the nozzle opening is typically significantly greater than the diameter of the hose and grip tube for the hose. A solution spray nozzle is typically provided on the nozzle so that a fan-shaped spray pattern is produced parallel to and a spaced distance from the nozzle opening.

One problem with the known accessory cleaning tools is that the nozzle opening is too large to be received in small spaces. For example, the known accessory cleaning tools cannot be received in the crevice between the seat bottom and seat back of a typical automobile seat. This cannot be done because the known tools have nozzles which depend at an acute angle from the axis of the grip tube and the nozzle openings are significantly larger than the diameter of the grip tube.

SUMMARY OF THE INVENTION

The crevice accessory cleaning tool according to the invention overcomes the problems of the prior art by dimensioning the nozzle opening so that the nozzle opening does not exceed the diameter of the hose.

In one aspect, the invention comprises an accessory cleaning tool adapted to be used with a water extraction cleaning machine. Typically, the cleaning machine has a vacuum conduit and a solution conduit extending therefrom. The accessory cleaning tool comprises a hollow, tubular-shaped body portion having a working air passageway formed therein. A tapered body portion extends from one end of the tubular body portion. The tapered body portion comprises a pair of opposed side walls extending from one end of the tubular body portion and the side walls gradually converge toward one another with increasing distance from the tubular body portion. Top and bottom walls of the tapered body portion extend from one end of the tubular body portion; the top and bottom walls intersect the opposed side walls and preferably are spaced from one another no more than the diameter of the tubular body portion. The opposed side walls and top and bottom walls define a working air passageway through the tapered body portion. The terminal edges of the side, top, and bottom walls define a nozzle opening. A spray nozzle is provided on one of the tubular body portion and tapered body portion and is adapted to be fluidly connected to the solution conduit of the water extraction cleaning machine. The spray nozzle directs a spray of cleaning solution onto a surface to be cleaned. With this structure, a spray nozzle has been incorporated into a crevice tool so that the crevice tool can be inserted into narrow spaces and spray solution can also be applied thereto.

In one embodiment, the fluid outlet of the spray nozzle is substantially circular in cross section so that pressurized fluid exiting the outlet creates a focused, circular spray pattern. However, in another embodiment, the outlet of the spray nozzle is rectangular in cross section. The longitudinal axis of the rectangular spray nozzle outlet can be aligned with or perpendicular to the nozzle opening of the tapered body portion.

Preferably, the tubular-shaped body portion, tapered body portion, and spray nozzle of the accessory cleaning tool are integrally molded as a single, unitary article. This will keep manufacturing costs of the article to a minimum.

In another aspect, the invention relates to an accessory cleaning tool adapted to be used with a water extraction cleaning machine. Typically, the cleaning machine has a vacuum conduit and a solution conduit extending therefrom. The accessory cleaning tool comprises a hollow body portion having a working air passageway formed therein and a longitudinal axis. A tapered body portion extends from one end of the hollow body portion and similarly has a working air passageway formed therein. The passageway of the tapered body portion terminates at a nozzle opening. The working air passageways of the hollow and tapered body portions are adapted to be fluidly connected to the vacuum conduit. The longitudinal axis of the hollow body portion passes through the nozzle opening so that a streamlined body contour is created. A spray nozzle is provided on one end of the tubular body portion and tapered body portion. The spray nozzle is adapted to be fluidly connected to the solution conduit of the water extraction cleaning machine and to direct a spray of cleaning solution onto a surface to be cleaned.

BRIEF DESCRIPTION OF THE DRAWINGS

The invention will now be described with reference to the drawings in which.

DETAILED DESCRIPTION OF THE PREFERRED EMBODIMENTS

Figure 1:
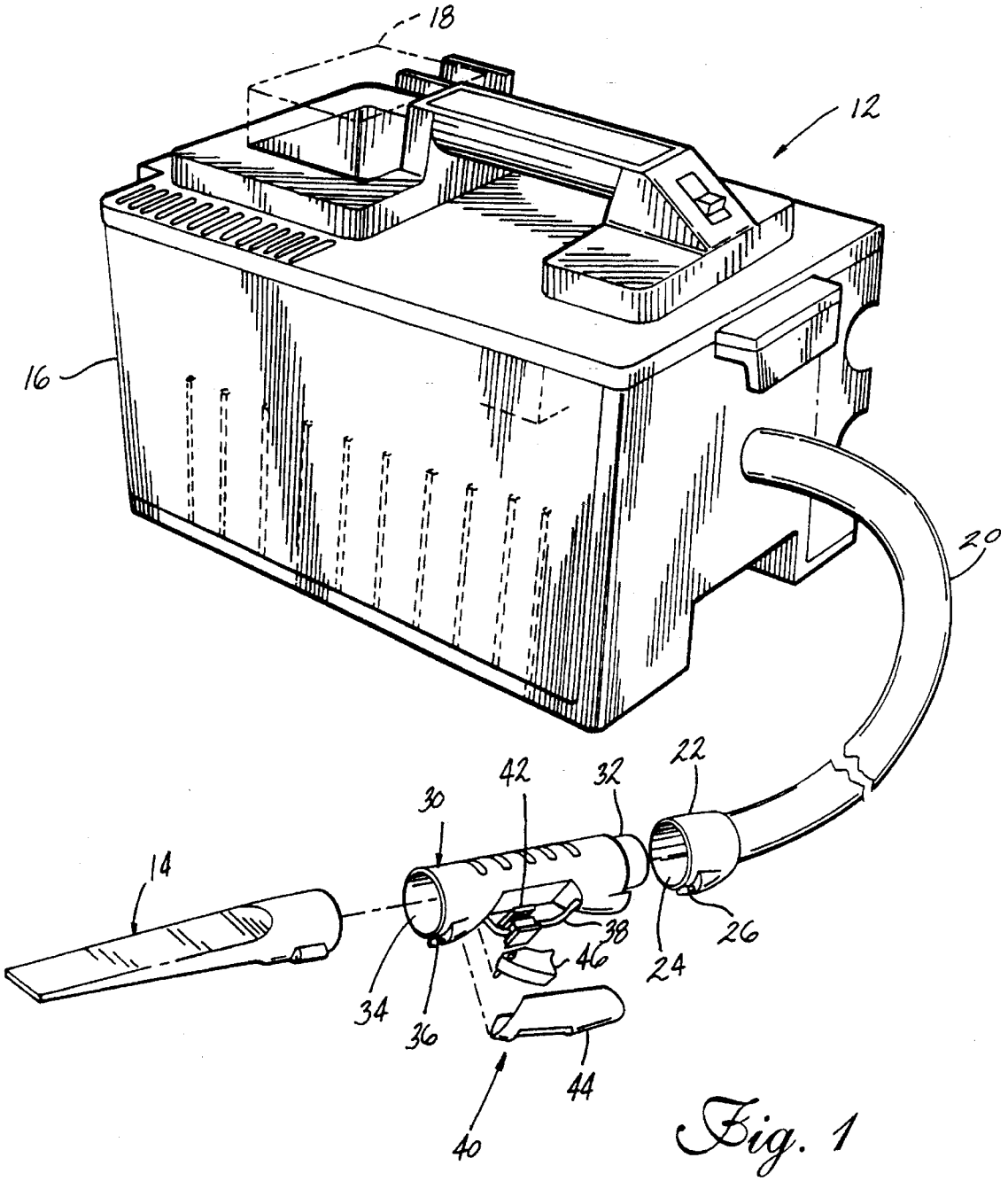
FIG. 1 is a perspective view of a conventional water extraction cleaning machine incorporating a crevice accessory cleaning tool according to the invention.

Referring now to the drawings and to FIG. 1 in particular, a water extraction cleaning machine 12 including a crevice accessory cleaning tool 14 according to the invention is shown. The water extraction cleaning machine comprises a housing 16 having a clean water solution reservoir (not shown), a fluid pump (not shown), a dirty solution reservoir (not shown), a vacuum motor (not shown), a concentrated cleaning solution container 18, and a flexible hose 20 extending therefrom. In this embodiment, the hose has a working air conduit and a solution conduit integrated therein. However, two separate hoses extending from the housing falls within the scope of the invention. A more complete description of the water extraction cleaning machine according to the invention illustrated in FIG. 1 is found in U.S. Pat. No. 4,910,828, issued Mar. 27, 1990 to Blase et al., which is expressly incorporated herein by reference. The water extraction cleaning machine shown in FIG. 1 is a compact water extraction cleaning machine. However, the accessory crevice cleaning tool according to the invention can be used with any water extraction cleaning machine adapted for use with an accessory hose including a canister-type water extraction cleaning machine as disclosed in U.S. Pat. No. 5,086,537, issued Feb. 11, 1992 to McDowell et al. and an upright water extraction cleaning machine as shown in U.S. Pat. No. 5,406,673 issued Apr. 18, 1995 to Bradd et al., both of which are expressly incorporated herein by reference.

In the embodiment in FIG. 1, one end of the hose 20 is secured to the housing 16. The other end of the hose has an end fitting 22 provided thereon having a working air passageway 24 and a male solution fitting 26 extending therefrom. The working air passageway 24 opens into the working air conduit of the flexible hose 20. Similarly, the male solution fitting 26 is in fluid communication with the solution conduit of the flexible hose 20.

A grip tube 30 is selectively mounted to the end fitting 22 of the hose 20. The grip tube 30 comprises a collar 32 which is telescopically received inside the working air passageway 24 of the end fitting 22 and a female solution fitting (not shown) adapted to telescopically receive the male solution fitting 26 of the end fitting 22. Opposite the collar 32, the grip tube 30 comprises a working air passageway 34 and a male solution fitting 36. An air/fluid conduit extends through the grip tube between the collar 32 and the working air passageway 34 on the end of the grip tube 30. Similarly, a flexible solution conduit 38 extends the length of the grip tube 30 interconnecting the female solution fitting adjacent the collar 32 and the male solution fitting 36.

A trigger mechanism 40 is provided on the underside of the grip tube 30 for controlling the distribution of cleaning solution onto the surface to be cleaned. The trigger mechanism comprises a solution conduit support member 42, a trigger mounting member 44, and a pivotally mounted trigger 46. The trigger 46 is pivotally mounted to the trigger mounting member 44 which is in turn mounted to the grip tube 30. The trigger 46 is biased to cooperate with the solution conduit support member 42 to selectively pinch closed the flexible solution conduit 38. As the user squeezes the trigger 46 relative to the grip tube 30, the solution conduit 38 is opened so that pressurized cleaning solution supplied by the fluid pump in the housing 16 can flow through the conduit 38.

Figure 2:
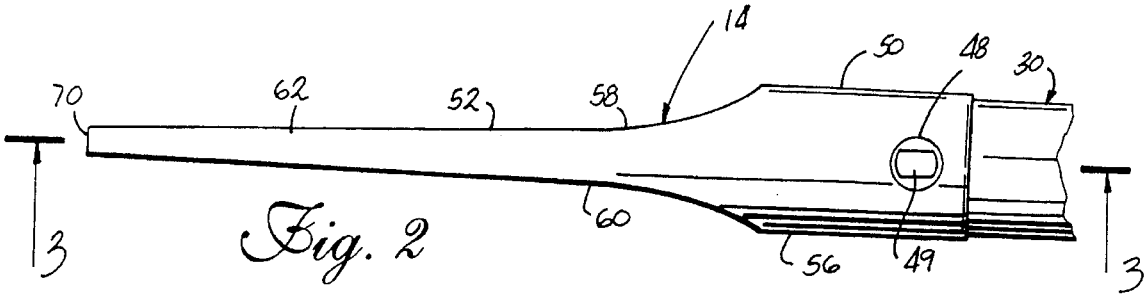
FIG. 2 is a top plan view of the crevice accessory cleaning tool according to the invention.
Figure 3:
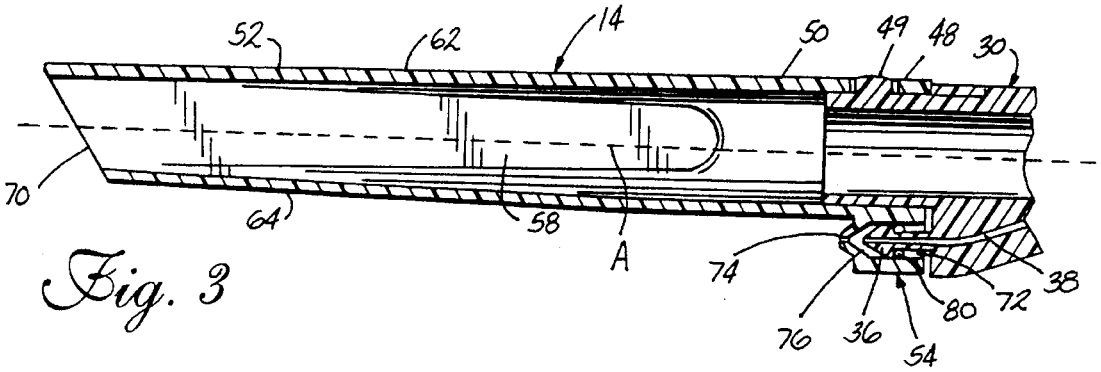
FIG. 3 is a cross-sectional view of the tool taken along lines 3—3 of FIG. 2.
Figure 4:
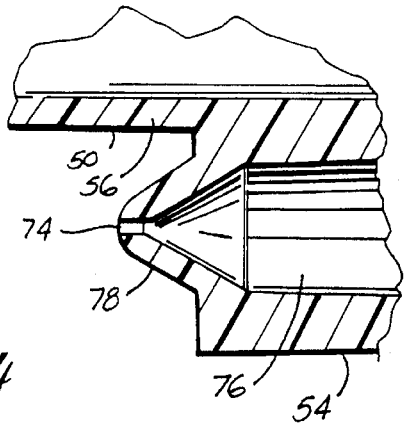
FIG. 4 is a cross-sectional detail view of a first embodiment of the spray nozzle of FIG. 3.
Figure 5:
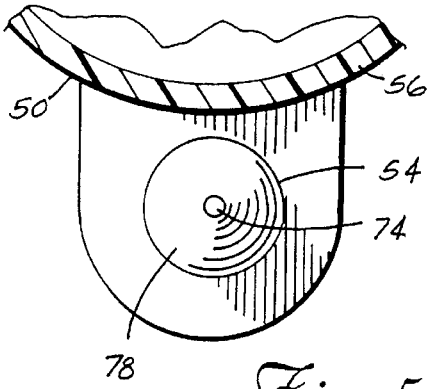
FIG. 5 is an end-elevational view of the spray nozzle of FIG. 4.

Referring now to FIGS. 1–3, the crevice accessory tool 14 comprises a hollow, tubular body portion 50, a hollow, tapered body portion 52, and a spray nozzle 54. Preferably, the accessory crevice tool is integrally molded from a thermoplastic material as a single, unitary article ready to be attached to one end of the accessory hose 20 and grip tube 30. The tubular body portion 50 comprises a tubular wall 56, and the tapered body portion 52 comprises a pair of opposed side walls 58, 60, a top wall 62, and a bottom wall 64. The top and bottom walls 62, 64 are preferably parallel to one another and the side walls 58, 60 and generally taper or converge toward one another with increasing distance from the tubular body portion 50. Preferably, the spacing between the top and bottom walls remains constant and does not exceed the diameter of the tubular body portion 50. An aperture 48 is formed in the tubular wall 56 of the tubular body portion 50 and a corresponding conventional deformable locking projection 49 is formed on the grip tube 30. The projection 49 and aperture 48 cooperate for selectively locking the tool 14 to the grip tube 30.

The several walls of the tapered body portion 52 terminate at edges which define a nozzle opening 70 provided at one end of the tool 14. Preferably, the nozzle opening 70 is rectangular in cross section so that the longitudinal axis of the opening 70 substantially exceeds the lateral axis of the opening 70. The nozzle opening 70 is also preferably planar along a plane which intersects the longitudinal axis of the tool 14 at an acute angle. The narrow, rectangular, angled opening is ideal for cleaning narrow cracks and crevices such as the crevice between an automotive seat and seat back. The grip tube 30 and tool 14 preferably have a common longitudinal axis A and this common axis preferably passes through the nozzle opening 70 provided at the end of the tool 14.

The spray nozzle 54 is preferably positioned on the bottom of the tubular body portion 50 so that the nozzle 54 will direct a spray of cleaning solution to a point immediately adjacent to the bottom of the nozzle opening 70. As seen in FIGS. 1–5 the nozzle 54 comprises a fluid inlet 72, a fluid outlet 74, a substantially hollow nozzle chamber 76, and a conical end wall 78. Preferably, the nozzle chamber 76 is circular in cross section and slidably receives the male solution fitting 36 of the grip tube 30 when the grip tube 30 and tool 14 are assembled. A conventional O-ring 80 is provided on the male solution fitting 36 to maintain a watertight seal between the fitting 36 and the inside wall of the nozzle chamber 76.

Several different embodiments of the spray nozzle 54 are within the scope of the invention. In the first embodiment shown in FIGS. 4 and 5, the fluid outlet 74 of the spray nozzle is circular in cross section and is formed at the tip of the conical end wall 78. The fluid outlet 74 is aimed so that pressurized fluid dispensed therefrom will pass immediately adjacent to the bottom of the nozzle opening 70. With this structure, a focused or narrow circular spray pattern will strike the surface being cleaned at a point immediately adjacent the bottom of the nozzle opening 70.

In use, the accessory crevice tool 14 is selectively mounted to the end of the grip tube 30 so that the tool 14 and grip tube 30 have a common longitudinal axis which passes through the nozzle opening 70. The locking projection 49 is received in the aperture 48 and the male solution fitting 36 is telescopically received in the nozzle chamber 76 thereby establishing fluid flow communication between the spray nozzle 54 and the solution conduit 38. Once the tool 14 is mounted to the grip tube 30, the user can distribute cleaning solution onto the surface to be cleaned by squeezing the trigger 46 of the grip tube 30. The pressurized fluid flows from the solution reservoir and pump in the machine housing 16, through the solution conduit of the hose 20, through the solution conduit 38 of the grip tube 30, through the male solution fitting 36 of the grip tube, and into the nozzle chamber 76. Finally, the pressurized solution flows out the fluid outlet 74 in a narrow circular spray pattern onto the surface to be cleaned. Depending upon whether the vacuum motor (not shown) is turned on, the discharged fluid and any dirt and dust entrained therein can be immediately withdrawn from the surface being cleaned or allowed to remain on the surface for a period of time prior to removal through the nozzle opening 70.

Figure 6:
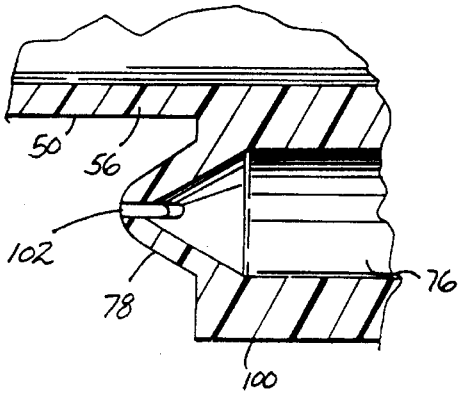
FIG. 6 is a cross-sectional detail view of a second embodiment of the spray nozzle similar to that shown in FIG. 4.
Figure 7:
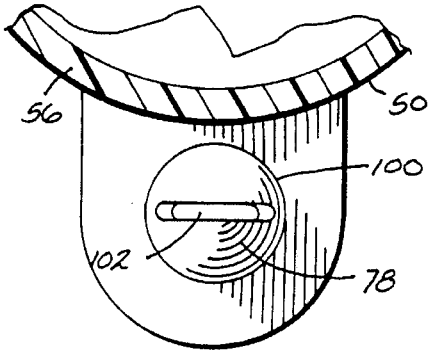
FIG. 7 is an end-elevational view of the spray nozzle of FIG. 6.

In the second and third embodiments of the spray nozzle, the structure of the elements such as the hose 20, grip tube 30, tubular body portion 50, and tapered body portion 52 are substantially the same as above and therefore the same reference numerals will be used. In the second embodiment illustrated in FIGS. 6 and 7, the spray nozzle 100 comprises a fluid inlet (not shown), a fluid outlet 102, a substantially hollow nozzle chamber 76, and a conical end wall 78. In this embodiment, the fluid outlet 102 is formed in the conical end wall 78, is rectangular in cross section, and is oriented so that the longitudinal axis of the fluid outlet 74 is substantially transverse to the longitudinal axis of the nozzle opening 70 of the tapered body portion 52. With this structure, the spray nozzle 100 will create a fan-shaped spray pattern which is spaced downwardly from the nozzle opening 70 and transverse to the longitudinal axis of the nozzle opening 70.

Figure 8:
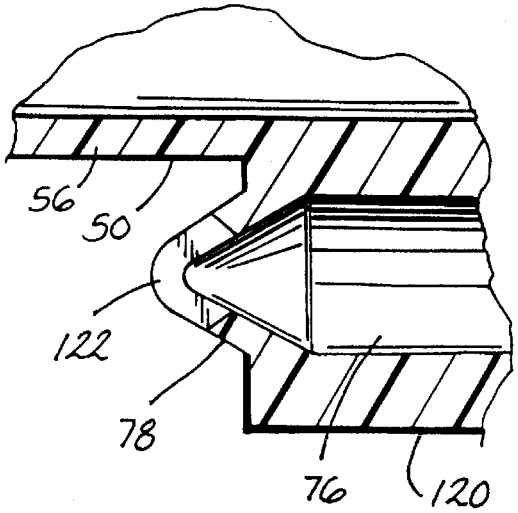
FIG. 8 is a cross-sectional detail view of a third embodiment of the spray nozzle similar to that shown in FIGS. 4 and 6.
Figure 9:
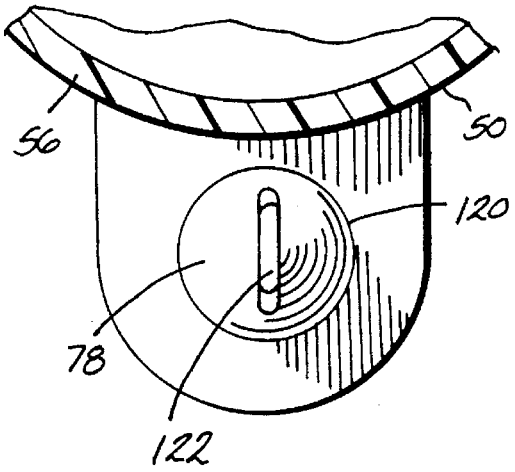
FIG. 9 is an end-elevational view of the spray nozzle of FIG. 8.

In the third embodiment illustrated in FIGS. 8 and 9, the spray nozzle 120 comprises a fluid inlet (not shown), a fluid outlet 122, a substantially hollow nozzle chamber 76, and a conical end wall 78. In this embodiment, the fluid outlet 122 formed in the conical end wall 78, is rectangular in cross section and is oriented so that the longitudinal axis of the fluid outlet 74 is substantially parallel to and aligned with the longitudinal axis of the nozzle opening 70 of the tapered body portion 52. With this structure, the spray nozzle 100 will create a fan-shaped spray pattern which is parallel to and aligned with the nozzle opening 70. As compared with the first embodiment, the spray nozzle 120 of the third embodiment will discharge a greater volume of cleaning solution and, unlike the second embodiment, the area being sprayed with the solution will be aligned with the nozzle opening 70 for efficient removal of the used solution and any entrained dirt and dust.

The accessory crevice tool 14, according to the invention, is a significant improvement in the water extraction cleaning art because narrow cracks or hard to reach spaces can now be simultaneously sprayed with a focused spray of cleaning solution and vacuumed to remove the solution, dirt, and dust. In view of the fact that the longitudinal axes of the tool 14 and grip tube 30 are aligned, the nozzle opening 70 formed on the end of the tool 14 can be received in narrow, deep cracks and crevices. In addition, true spot cleaning can now be performed with the focused application of cleaning solution and vacuum suction. The variety of spray nozzles within the scope of the invention create adaptability of the tool for a variety of cleaning processes and applications.

Reasonable variation and modification are possible within the spirit of the foregoing specification and drawings without departing from the scope of the invention.

The embodiments for which an exclusive property or privilege is claimed are defined as follows:

1. An accessory cleaning tool adapted to be used with a water extraction cleaning machine having a vacuum conduit and a solution conduit extending therefrom, the accessory cleaning tool comprising:

a hollow, tubular body portion having a prescribed diameter and a working air passageway formed therein;

a tapered body portion extending from one end of the tubular body portion, the tapered body portion comprising:

a pair of opposed side walls extending from one end of the tubular body portion to terminal edges wherein the side walls gradually converge toward one another with increasing distance from the tubular body portion; and top and bottom walls extending from one end of the tubular body portion, terminating at terminal edges and intersecting the opposed side walls, the top and bottom walls being spaced from one another no more than the prescribed diameter of the tubular body portion and, in conjunction with the opposed side walls, defining a working air passageway which is fluidly connected to the working air passageway of the tubular body portion;

a nozzle opening formed by the terminal edges of the top, bottom and opposed side walls and fluidly opening into the working air passageway of the tapered body portion; and a spray nozzle provided on one of the tubular body portion and tapered body portion and being adapted to be fluidly connected to the solution conduit of the water extraction cleaning machine and to direct a spray of cleaning solution onto a surface to be cleaned.

2. An accessory cleaning tool according to claim 1 wherein the spray nozzle comprises a hollow nozzle body having a fluid inlet and outlet formed therein, the fluid outlet being substantially circular in cross section and several times smaller than the fluid inlet so that pressurized fluid exiting the fluid outlet of the nozzle body creates a focused, circular spray pattern.

3. An accessory cleaning tool according to claim 2 wherein the fluid outlet is positioned relative to the tubular body portion to provide the focused, circular solution spray pattern at a point immediately adjacent to the nozzle opening.

4. An accessory cleaning tool according to claim 1 wherein the terminal edges of the opposed side walls are longer than the terminal edges of the top and bottom walls so that the nozzle opening of the tubular body portion is substantially rectangular in cross section and the spray nozzle comprises a hollow nozzle body having a fluid inlet and outlet formed therein, the fluid outlet being substantially rectangular in cross section and positioned with respect to the tubular body portion so that pressurized fluid exiting the fluid outlet creates a fan shaped pattern having a longitudinal axis which is substantially parallel to and aligned with a longitudinal axis of the rectangular nozzle opening.

5. An accessory cleaning tool according to claim 4 wherein the fluid outlet is positioned to provide the solution spray at a point immediately adjacent to one end of the nozzle opening.

6. An accessory cleaning tool according to claim 1 wherein the terminal edges of the opposed side walls are longer than the terminal edges of the top and bottom walls so that the nozzle opening of the tubular body portion is substantially rectangular in cross section and the spray nozzle comprises a hollow nozzle body having a fluid inlet and outlet formed therein, the fluid outlet being substantially rectangular in cross section and positioned with respect to the tubular body portion so that pressurized fluid exiting the fluid outlet creates a fan shaped pattern having a longitudinal axis which is substantially perpendicular to a side wall edge of the rectangular nozzle opening.

7. An accessory cleaning tool according to claim 6 wherein the fluid outlet is positioned relative to the tubular body portion to provide the fan shaped solution spray immediately adjacent to one end of the nozzle opening.

8. An accessory cleaning tool according to claim 1 wherein the top and bottom walls are substantially parallel to one another.

9. An accessory cleaning tool according to claim 1 wherein the cleaning tool further comprises a longitudinal axis and the nozzle opening lies along a plane intersecting the longitudinal axis at an acute angle.

10. An accessory cleaning tool according to claim 1 wherein the tubular shaped body portion, tapered body portion and spray nozzle are integrally molded as a unitary article.

11. In an improved water extraction cleaning machine comprising a source of cleaning solution, a pump for pressurizing said cleaning solution, a vacuum motor for creating a working airflow, a reservoir for receiving the working airflow and the used cleaning solution, dirt and dust entrained therein, an accessory vacuum hose having a first end in fluid communication with the reservoir and vacuum motor, a solution conduit having a first end in fluid communication with the pump, the improvement comprising:

an accessory cleaning tool comprising:

a hollow, tubular body portion having a prescribed diameter and a working air passageway formed therein;

a tapered body portion extending from one end of the tubular body portion, the tapered body portion comprising:

a pair of opposed side walls extending from said one end of the tubular body portion to terminal edges wherein the side walls gradually converge toward one another with increasing distance from the tubular body portion; and top and bottom walls extending from said one end of the tubular body portion, terminating at terminal edges and intersecting the opposed side walls, the top and bottom walls being spaced from one another no more than the prescribed diameter of the tubular body portion and, in conjunction with the opposed side walls, defining a working air passageway which is fluidly connected to the working air passageway of the tubular body portion;

a nozzle opening defined by the terminal edges of the top, bottom and opposed side walls and fluidly opening into the working air passageway of the tubular body portion; and a spray nozzle provided on one of the tubular body portion and tapered body portion and being adapted to be fluidly connected to the solution conduit of the water extraction cleaning machine and to direct a spray of cleaning solution onto a surface to be cleaned.

12. An improved water extraction cleaning machine according to claim 11 wherein the spray nozzle comprises a hollow nozzle body having a fluid inlet and outlet formed therein, the fluid outlet being substantially circular in cross section so that pressurized fluid supplied by the pump and exiting the fluid outlet of the nozzle body creates a focused, circular spray pattern.

13. An improved water extraction cleaning machine according to claim 12 wherein the fluid outlet is positioned relative to the tubular body portion to provide the focused, circular solution spray pattern at a point immediately adjacent to the nozzle opening.

14. An improved water extraction cleaning machine according to claim 11 wherein the terminal edges of the opposed side walls are longer than the terminal edges of the top and bottom walls so that the nozzle opening of the tubular body portion is substantially rectangular in cross section and the spray nozzle comprises a hollow nozzle body having a fluid inlet and outlet formed therein, the fluid outlet being substantially rectangular in cross section and positioned with respect to the tubular body portion so that pressurized fluid exiting the fluid outlet creates a fan shaped pattern having a longitudinal axis which is substantially parallel to and aligned with a longitudinal axis of the rectangular nozzle opening.

15. An improved water extraction cleaning machine according to claim 14 wherein the fluid outlet is positioned to provide the solution spray at a point immediately adjacent to one end of the nozzle opening.

16. An improved water extraction cleaning machine according to claim 11 wherein the terminal edges of the opposed side walls are longer than the terminal edges of the top and bottom walls so that the nozzle opening of the tubular body portion is substantially rectangular in cross section and the spray nozzle comprises a hollow nozzle body having a fluid inlet and outlet formed therein, the fluid outlet being substantially rectangular in cross section and positioned with respect to the tubular body portion so that pressurized fluid exiting the fluid outlet creates a fan shaped pattern having a longitudinal axis which is substantially perpendicular to and spaced from a side wall edge of the rectangular nozzle opening.

17. An improved water extraction cleaning machine according to claim 11 wherein the cleaning tool further comprises a longitudinal axis and the nozzle opening lies along a plane intersecting the longitudinal axis at an acute angle.

18. An improved water extraction cleaning machine according to claim 11 wherein the tubular shaped body portion, tapered body portion and spray nozzle are integrally molded as a unitary article.

19. An accessory cleaning tool adapted to be used with a water extraction cleaning machine having a vacuum conduit and a solution conduit extending therefrom, the accessory cleaning tool comprising:

a hollow body portion having a working air passageway formed therein and a longitudinal axis;

a tapered body portion extending from one end of the hollow body portion and having a working air passageway formed therein terminating at a nozzle opening, wherein the working air passageways of the hollow and tapered body portions are adapted to be fluidly connected to the vacuum conduit and the longitudinal axis of the hollow body portion passes through the nozzle opening; and a spray nozzle provided on one of the hollow tool body portion and tapered body portion and being adapted to be fluidly connected to the solution conduit of the water extraction cleaning machine and to direct a spray of cleaning solution onto a surface to be cleaned.

20. In an improved water extraction cleaning machine comprising a source of cleaning solution, a pump for pressurizing said cleaning solution, a vacuum motor for creating a working airflow, a reservoir for receiving the working airflow and the used cleaning solution, dirt and dust entrained therein, an accessory vacuum hose having a first end in fluid communication with the reservoir and vacuum motor, and a solution conduit having a first end in fluid communication with the pump, the improvement comprising:

an accessory cleaning tool comprising:

a hollow body portion having a working air passageway formed therein and having a longitudinal axis;

a tapered body portion extending from one end of the hollow tool body portion and having a working air passageway terminating at a nozzle opening wherein the longitudinal axis of the hollow body portion passes through the nozzle opening and the working air passageways of hollow and tapered body portions are adapted to be fluidly connected to the vacuum motor; and a spray nozzle provided on one of the tubular body portion and tapered body portion and being adapted to be fluidly connected to the solution conduit of the water extraction cleaning machine and to direct a spray of cleaning solution onto a surface to be cleaned.

21. An accessory cleaning tool according to claim 19 wherein the spray nozzle comprises a hollow nozzle body having a fluid inlet and outlet formed therein, the fluid outlet being substantially circular in cross section and several times smaller than the fluid inlet so that pressurized fluid exiting the fluid outlet of the nozzle body creates a focused, circular spray pattern.

22. An accessory cleaning tool according to claim 21 wherein the fluid outlet is positioned relative to the hollow tool body portion to provide the focused, circular solution spray pattern at a point immediately adjacent to the nozzle opening.

23. An accessory cleaning tool according to claim 19 wherein the terminal edges of the opposed side walls are longer than the terminal edges of the top and bottom walls so that the nozzle opening of the hollow tool body portion is substantially rectangular in cross section and the spray nozzle comprises a hollow nozzle body having a fluid inlet and outlet formed therein, the fluid outlet being substantially rectangular in cross section and positioned with respect to the hollow tool body portion so that pressurized fluid exiting the fluid outlet creates a fan shaped pattern having a longitudinal axis which is substantially parallel to and aligned with a longitudinal axis of the rectangular nozzle opening.

24. An accessory cleaning tool according to claim 23 wherein the fluid outlet is positioned to provide the solution spray at a point immediately adjacent to one end of the nozzle opening.

25. An accessory cleaning tool according to claim 19 wherein the terminal edges of the opposed side walls are longer than the terminal edges of the top and bottom walls so that the nozzle opening of the hollow tool body portion is substantially rectangular in cross section and the spray nozzle comprises a hollow nozzle body having a fluid inlet and outlet formed therein, the fluid outlet being substantially rectangular in cross section and positioned with respect to the hollow tool body portion so that pressurized fluid exiting the fluid outlet creates a fan shaped pattern having a longitudinal axis which is substantially perpendicular to a side wall edge of the rectangular nozzle opening.

26. An accessory cleaning tool according to claim 25 wherein the fluid outlet is positioned relative to the hollow tool body portion to provide the fan shaped solution spray immediately adjacent to one end of the nozzle opening.

27. An accessory cleaning tool according to claim 19 wherein the top and bottom walls are substantially parallel to one another.

28. An accessory cleaning tool according to claim 19 wherein the cleaning tool further comprises a longitudinal axis and the nozzle opening lies along a plane intersecting the longitudinal axis at an acute angle.

29. An accessory cleaning tool according to claim 19 wherein the hollow tool body portion, tapered body portion and spray nozzle are integrally molded as a unitary article.

30. An improved water extraction cleaning machine according to claim 20 wherein the spray nozzle comprises a hollow nozzle body having a fluid inlet and outlet formed therein, the fluid outlet being substantially circular in cross section so that pressurized fluid supplied by the pump and exiting the fluid outlet of the nozzle body creates a focused, circular spray pattern.

31. An improved water extraction cleaning machine according to claim 30 wherein the fluid outlet is positioned relative to the hollow tool body portion to provide the focused, circular solution spray pattern at a point immediately adjacent to the nozzle opening.

32. An improved water extraction cleaning machine according to claim 20 wherein the terminal edges of the opposed side walls are longer than the terminal edges of the top and bottom walls so that the nozzle opening of the hollow tool body portion is substantially rectangular in cross section and the spray nozzle comprises a hollow nozzle body having a fluid inlet and outlet formed therein, the fluid outlet being substantially rectangular in cross section and positioned with respect to the hollow tool body portion so that pressurized fluid exiting the fluid outlet creates a fan shaped pattern having a longitudinal axis which is substantially parallel to and aligned with a longitudinal axis of the rectangular nozzle opening.

33. An improved water extraction cleaning machine according to claim 32 wherein the fluid outlet is positioned to provide the solution spray at a point immediately adjacent to one end of the nozzle opening.

34. An improved water extraction cleaning machine according to claim 20 wherein the terminal edges of the opposed side walls are longer than the terminal edges of the top and bottom walls so that the nozzle opening of the hollow tool body portion is substantially rectangular in cross section and the spray nozzle comprises a hollow nozzle body having a fluid inlet and outlet formed therein, the fluid outlet being substantially rectangular in cross section and positioned with respect to the hollow tool body portion so that pressurized fluid exiting the fluid outlet creates a fan shaped pattern having a longitudinal axis which is substantially perpendicular to and spaced from a side wall edge of the rectangular nozzle opening.

35. An improved water extraction cleaning machine according to claim 20 wherein the cleaning tool further comprises a longitudinal axis and the nozzle opening lies along a plane intersecting the longitudinal axis at an acute angle.

36. An improved water extraction cleaning machine according to claim 20 wherein the hollow tool body portion, tapered body portion and spray nozzle are integrally molded as a unitary article.

* * * * *

UNITED STATES PATENT AND TRADEMARK OFFICE

CERTIFICATE OF CORRECTION

PATENT NO. : 5,613,272

DATED : March 25, 1997

INVENTOR(S) : ERIC C. HUFFMAN

It is certified that error appears in the above-indentified patent and that said Letters Patent is hereby corrected as shown below:

Column 9, claim 20, line 22:
"tubular" should be --hollow tool--.

Signed and Sealed this

Fifteenth Day of July, 1997

Bruce Lehman

*Attest:*

BRUCE LEHMAN

*Attesting Officer*

*Commissioner of Patents and Trademarks*